United States Patent [19]

Brock et al.

[11] 4,190,370

[45] Feb. 26, 1980

[54] ASPHALT PLANT WITH IMPROVED TEMPERATURE CONTROL SYSTEM

[75] Inventors: James D. Brock; Erbie G. Mize, both of Chattanooga, Tenn.

[73] Assignee: Astec Industries, Inc., Chattanooga, Tenn.

[21] Appl. No.: 963,445

[22] Filed: Nov. 24, 1978

[51] Int. Cl.[2] ..... B28C 5/46

[52] U.S. Cl. ..... 366/25; 366/233

[58] Field of Search ..... 366/2, 4, 7, 12, 40, 366/137, 144, 145, 159, 24, 25, 185, 208, 220, 215, 53, 237

[56] References Cited

U.S. PATENT DOCUMENTS

| | | | |
|---|---|---|---|
| Re. 29,496 | 12/1977 | Dydzyk | 366/25 |
| 3,614,071 | 10/1971 | Brock | 366/4 |
| 3,674,242 | 7/1972 | Steward | 366/25 |
| 4,025,057 | 5/1977 | Shearer | 366/25 |

*Primary Examiner*—Edward J. McCarthy

*Attorney, Agent, or Firm*—Jones, Thomas & Askew

[57] ABSTRACT

Continuous asphalt plant including a temperature control system for controlling the temperature of the asphalt-aggregate mix by varying the flow of hot gases through a mixing enclosure. The temperature of the source of heat, such as a flame burner, is controlled to maintain the temperature of the hot gases as they enter the mixing enclosure, and the hot gases are recirculated to assist in controlling the temperature of the hot gases entering the mixing enclosure and to provide more efficient operation of the plant.

19 Claims, 3 Drawing Figures

ASPHALT PLANT WITH IMPROVED TEMPERATURE CONTROL SYSTEM

DESCRIPTION

BACKGROUND OF THE INVENTION

The present invention relates in general to apparatus for the manufacture of asphalt-aggregate material, and in particular to continuous asphalt plants such as drum mix plants.

Drum mixing apparatus is known for use in the preparation of asphalt-aggregate paving compositions. It is generally recognized that drum mix asphalt plants provide certain advantages in comparison with other types of asphalt plants, including the economy of continuous-flow operation and relative portability for transportation between job locations. A typical drum mix asphalt plant includes a rotating mixing drum in which aggregate material and asphalt material are separately added and mixed together while being heated to provide the desired asphalt-aggregate mixture. The contents of the mixing drum are heated by a fuel burner located at one end of the drum, and the asphalt-aggregate mixture is removed from the other end of the drum for immediate use or temporary storage in a manner known to those skilled in the art.

The introduction and agitation of aggregate material in the mixing drum of a drum mix asphalt plant, combined with the heating of the aggregate material, produces a substantial volume of dust and other relatively fine airborne particulate mineral matter which emerges from the mixing drum. The amount of such airborne particulate matter may exceed prevailing standards of allowable air pollution, and so drum mix asphalt plants are increasingly required to operate in conjunction with suitable apparatus for reducing the particulate matter to an acceptable maximum level. While fiber filter dust collection systems and venturi scrubber systems are frequently used to remove dust and similar fine particulate matter produced by heating and agitating aggregate material alone, the amount of smoke produced by recycling used asphalt-aggregate material in drum mix asphalt plants is potentially more than can be practically removed by fiber filter and venturi dust collection systems with such plants.

Smoke is also produced in drum mix asphalt plants by so-called "flashing" of the liquid asphalt material upon exposure to the elevated temperature within the mixing drum, and is caused by evaporation of light end hydrocarbons of the asphalt material to produce blue smoke emissions. These hydrocarbon smoke emissions will rapidly and permanently clog the porous filter media within the typical so-called "baghouse" fiber filter dust collection system rendering the baghouse inoperative until the filter bags are replaced. Replacement of fuel-clogged filter bags is an expensive expedient and renders the baghouse (and therefore the entire drum mix asphalt plant) inoperative for a period of time.

The recycling of old asphalt-aggregate material such as roadway material is very desirable from an economic viewpoint. If a roadway can be torn up and used to replace fifty to one hundred percent of the new virgin aggregate and liquid asphalt otherwise needed to re-surface the roadway, a substantial raw materials cost saving may be realized. However, the use of old asphalt-aggregate material aggravates the smoking problem due to the fact that the aggregate is already coated with asphalt when it is subjected to high temperatures in a drum mix plant. In order to eliminate or minimize the smoking of material being recycled in drum mix plants, several systems have been proposed.

In one prior art method the used asphalt-aggregate material is introduced, along with virgin aggregate, at or near the fuel burner used to heat the virgin aggregate material at the upper end of the drum mixer, which is generally inclined so that the material within the drum will gradually move toward the removal point as the drum rotates. This method, however, causes the used asphalt-aggregate material to smoke excessively, and it has been found that a plant using this method cannot be operated within current air pollution standards.

Another prior art system utilizes a drum within a drum whereupon the used asphalt-aggregate material is introduced into the upper end of an outer drum and virgin aggregate is introduced into an inner drum which contains the heat source. After the virgin aggregate has been heated, it emerges from the inner drum for mixing with the material being recycled in the outer drum. A disadvantage of this prior art system is that it has a small capacity for production using only virgin materials. Thus, such a plant is inefficient for use where old asphalt material is not available.

A third prior art system has been used solely for recycling used asphalt material. The interior of the drum mixer is heated by circulating heated fluid through tubing within the drum, and the used asphalt material is tossed about the drum outside the tubes. It has been found that asphalt-aggregate material when heated tends to adhere to the tubes and block off the mixing drum. Also, a second complete drum mix plant is required if virgin materials are to be used.

A fourth prior art system is shown in U.S. Pat. No. 3,999,743 which discloses a system for crushing and sorting used asphalt aggregate material by size, introducing coarse particles into the flame of the fuel burner, and introducing smaller particles at locations more distant from the burner. The particles are admitted directly into the drum through the cylindrical wall of the drum as it rotates by way of a plurality of complex feeding mechanisms. A disadvantage of such a system is that the burner temperature must be held low enough to prevent burning the coarse particles, resulting in a lower temperature in the lower end of the drum and therefore a lower production rate since more time is required for sufficient heating of the material. Further disadvantages are the lack of provision for the simultaneous use of virgin raw materials with used material and the expensive nature of the complex side-delivery system disclosed.

Another prior system introduces the used material and the virgin material at the upper end of the rotating drum adjacent a burner. A burner shield projecting into the drum prevents the flame of the burner from directly contacting the asphalt material. An excess amount of air is pulled into the combustion area of the burner to cool the combustion gases to such an extent that the temperature of the gases upon contact with the asphalt material does not produce smoking of the asphalt material. Sufficient heating of the asphalt mix material in the drum is provided by regulating the burner in response to the temperature of the asphalt material exiting the drum. A disadvantage of this system is that it inherently uses fuel for the burner inefficiently since an excess of cool air is used to lower the temperature of the combustion gases. Furthermore, if the exit temperature of the mix is too low, the burner temperature may be increased automatically to a point where smoking of the used material will occur unless still more excess air is introduced.

SUMMARY OF THE INVENTION

Generally described, the present invention provides an apparatus and method for producing asphalt-aggregate material including an improved temperature control system whereby the temperature of the asphalt-aggregate mix leaving the mixing enclosure of the asphalt plant is regulated by adjusting the flow of hot gases through the mixing enclosure. The temperature of the gases entering the enclosure is monitored and maintained at a selected level by automatic adjustment of the heat source that provides hot gases to the enclosure.

Thus, by increasing the mass flow rate of hot gases through the mixing enclosure, the final temperature of the mix may be raised without raising the temperature of combustion gases entering the enclosure, and when recycling used asphalt-aggregate material, the final mix temperature can be varied without exposing the used material to excessive temperatures which would cause smoking.

A further refinement to an apparatus according to the invention provides recirculation of exhaust gases from the mixing enclosure to be mixed with the combustion gases prior to contact with the asphaltic raw materials in the mixing enclosure. Less energy is then needed to raise the temperature of the gases contacting the raw materials to the desired level, because the recirculated gases are hotter than the ambient air which would otherwise be drawn in to be mixed with the burner combustion gases.

More specifically described, the present invention provides an improved drum mix plant which includes a rotating elongate inclined mixing drum having openings at each end for introduction and removal of asphalt-aggregate material from the drum, an adjustable burner at one end of the drum for heating the contents thereof, ducts for removing heated gases from the drum and directing a portion of said gases to a baghouse for removal of particulate material and for directing the remainder of said gases to a manifold surrounding the burner for mixing and cooling of the higher temperature gases of the burner. Dampers within the ducts may be opened and closed in response to temperature sensors placed adjacent the entrance point and the exit point of the asphalt-aggregate material in the drum thereby regulating the volume of gases flowing through the drum. The sensors may also regulate the amount of fuel supplied to the burner and thereby control the degree of heating of recycled gases.

Accordingly, it is an object of the present invention to provide an improved asphalt plant apparatus.

Another object of the present invention is to provide asphalt plant apparatus which minimizes or eliminates the amount of smoking associated with the production of asphalt-aggregate material, especially when recycling used asphalt-aggregate material.

Yet another object of the present invention is to provide asphalt plant apparatus which requires less energy to operate than conventional asphalt plants.

A further object of the present invention is to provide asphalt plant apparatus which recirculates through the drum gases which are removed from one end of the plant.

Still another object of the present invention is to provide an improvement in asphalt plants which is applicable to both parallel flow heat exchange plants and counter-flow heat exchange plants.

Yet another object of the present invention is to provide asphalt plant apparatus which controls the temperature of combustion gases to prevent smoking of used asphalt-aggregate material.

A further object of the present invention is to provide asphalt plant apparatus which controls the asphalt-aggregate product temperature by controlling the flow of recirculated gases through the apparatus.

Another object of the present invention is to provide an improved method of producing asphalt aggregate material.

It is yet another object of the present invention to provide asphalt plant apparatus which does not require a baghouse or venturi scrubber of as great a capacity as conventional asphalt plants require for recycling asphalt-aggregate material.

These and other objects, features and advantages of the present invention will become apparent from a review of the following detailed description of the disclosed embodiment and the appended drawing and claims.

DETAILED DESCRIPTION

Figure 1:
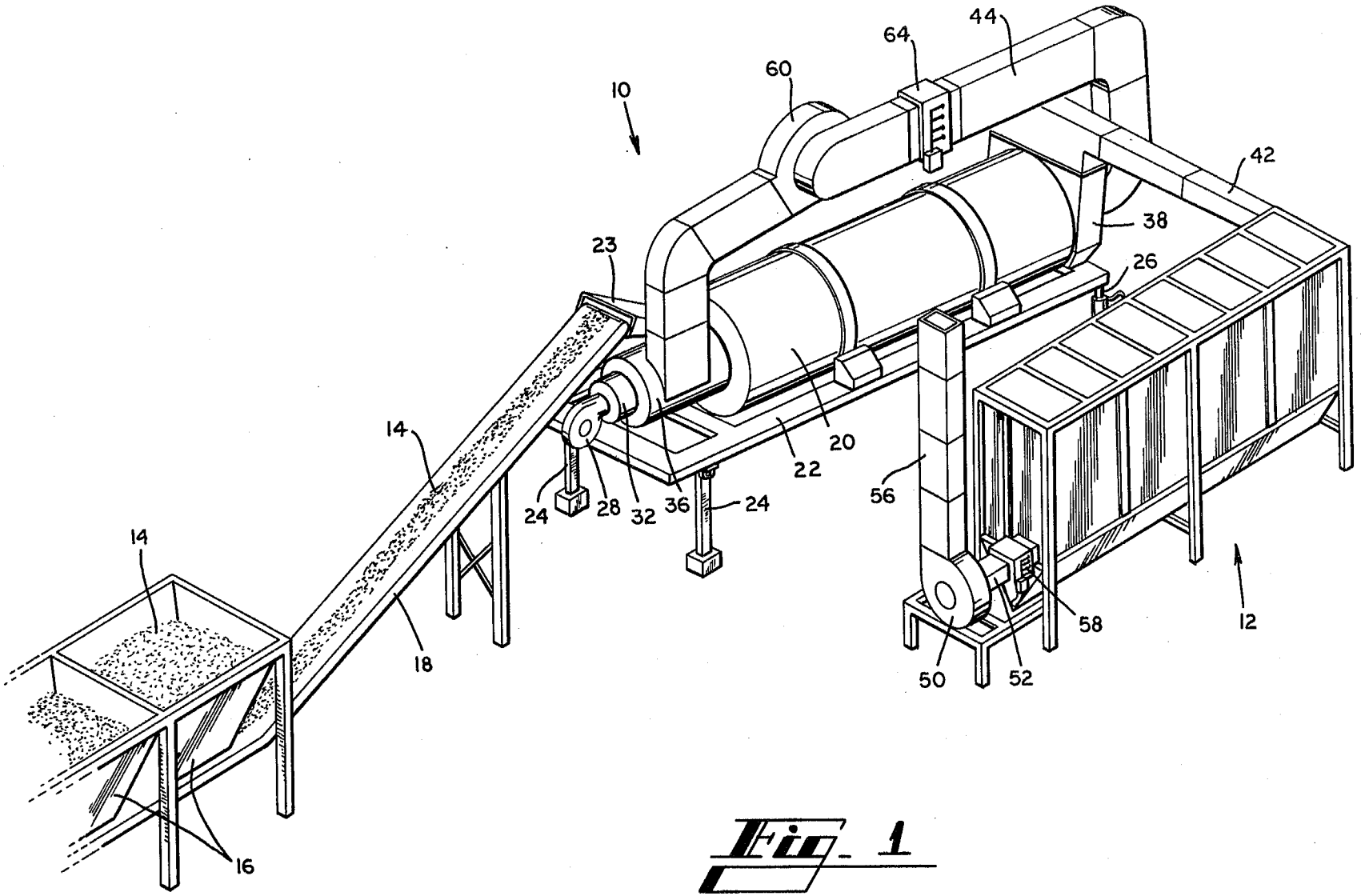
FIG. 1 is a plan view of a disclosed embodiment of asphalt plant apparatus of the present invention.

Referring to the drawing in which like numbers indicate like elements, it will be seen that there is a drum mix plant 10 adjacent a baghouse 12 and a supply of virgin aggregate and/or used asphalt-aggregate material 14 contained in storage bins 16. The asphalt-aggregate material 14 feeds out of the storage bins 16 onto a conveyor belt 18 for delivery to the drum mix plant 10 in a manner well known in the art.

The drum mix plant 10 includes an elongate mixing drum 20 rotatably mounted on a support frame 22. A chute 23 receives the asphalt-aggregate material 14 as it drops off the end of the conveyor 18 and funnels the material into the drum 20. Pivotally attached at one end of the support frame 22 are a pair of support legs 24. Attached at the other end of the support frame 22 are a pair of extendable support legs 26. The length of the legs 26 may be adjusted by various methods known in the art, but preferably hydraulically. In their unextended configuration, the legs 26 are generally of a shorter length than the legs 24. In this configuration, the drum 20 is mounted at an angle inclined from horizontal. As the legs 26 are extended, the angle of inclination of the drum 20 is reduced. However, it is desirable that the drum 20 always be maintained at some inclined angle so that material within the drum will feed down the length of the drum due to the affect of gravity as the drum is rotated. The adjustability of the legs 26 therefore provides a means for controlling the rate at which material will feed down the length of the drum 20 at a particular rate of rotation of the drum.

Figure 2:
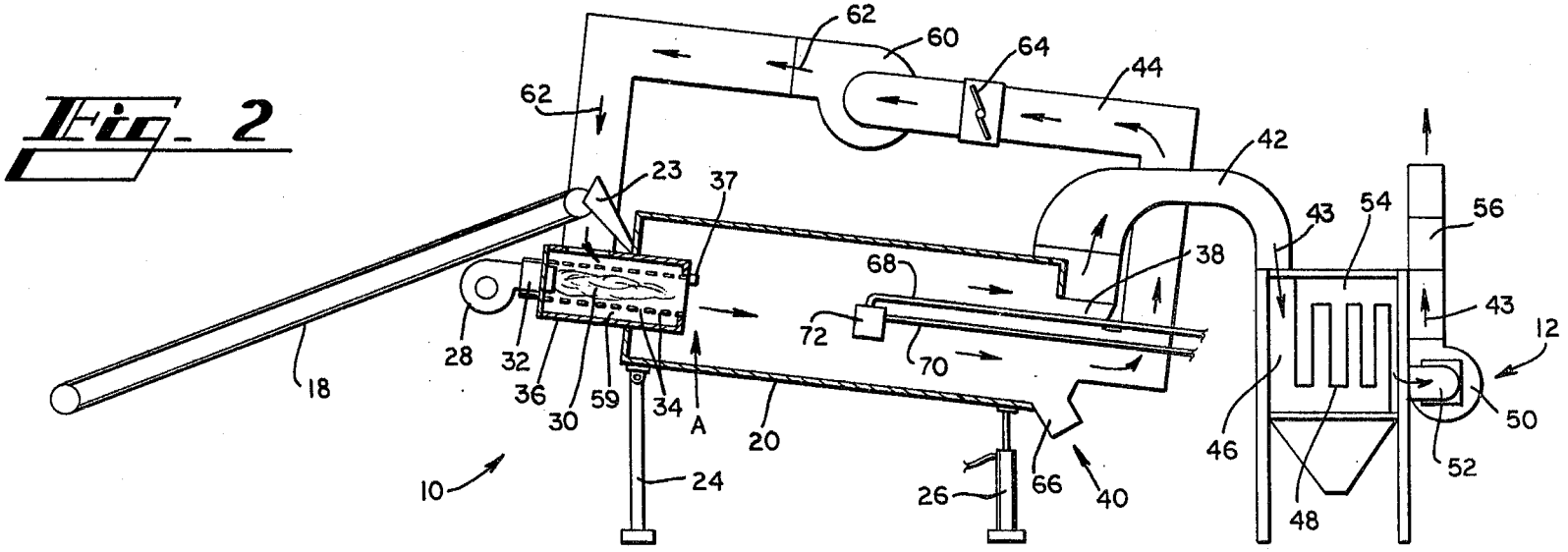
FIG. 2 is a schematic diagram of the air flow through the asphalt plant shown in FIG. 1.

Located at the upper end of the drum 20 is a heat source, such as a conventional gas burner 28. The burner 28 projects a flame 30 into a pipe 32 which extends from outside the drum 20 into the upper end of the drum, the pipe 32 having perforations 34 therein, as shown in FIG. 2. Surrounding the perforated portion of the pipe 32 and extending into and out of the drum 20 is an input manifold 36. The burner 28 is connected by an electric circuit to a temperature sensor 37 which regulates the flame 30 of the burner in response to the temperature of the gases as they leave the perforated pipe 32 and enter the drum 20.

Located at the lower end of the drum 20 is an exhaust manifold 38 which has an opening 40 at the bottom thereof for removal of asphalt-aggregate material from the drum 20. The exhaust manifold 38 is attached to two ducts 42, 44 which are adapted for conducting gases and suspended particulate matter away from the exhaust manifold 38. The exhaust duct 42 leads from the exhaust manifold 38 to a conventional baghouse 12. The baghouse 12 is of a design known in the art and includes an internal filter chamber 46 within which extend a number of fiber filter collectors 48 in the form of a filter bag. Air flow through the baghouse 12 is provided by an exhaust fan 50 having an inlet duct 52 connected to a plenum chamber 54 of the baghouse. The output of the exhaust fan 50 is connected to an exhaust stack 56 which opens at the top to the atmosphere for discharge of the air filtered through the baghouse 12. Located at a point on the fan inlet duct 52 intermediate the baghouse 12 and the exhaust fan 50 is an exhaust damper 58 which may be electrically operated to regulate the volume of air flowing through the baghouse to the atmosphere, which is also the volume of air being removed from the drum mix plant 10. The exhaust damper 58 is connected by an electric circuit to an atmospheric pressure sensor 59 which activates the exhaust damper in response to the ambient pressure in the input manifold 36 in a manner described below.

The return duct 44 leads from the exhaust manifold 38 to the input manifold 36. Located at a point on the return duct 44 intermediate the exhaust manifold 38 and the input manifold 36 is a recirculation fan 60 driven by a motor (not shown) such that gases are forced to flow through the return duct in a direction shown by the arrows 62. Adjacent the recirculation fan 60 is a recirculation damper 64 which may be electrically operated to regulate the volume of gases flowing through the return duct 44. The recirculation damper 64 is connected by an electric circuit to a temperature sensor 66 which activates the recirculation damper in response to the temperature of the asphalt-aggregate material as it leaves the drum 20 through the opening 40, in a manner described below.

The concept of the present invention whereby the temperature of the asphalt-aggregate mix leaving the drum 20 is regulated by adjusting the flow of hot gases through the drum 20 may be practiced using an apparatus not including the return duct 44 as shown in the preferred embodiment described herein. In such an apparatus the entire volume of gases leaving the drum 20 would enter the exhaust duct 42 and be expelled to atmosphere through the baghouse 12. Instead of recirculating gases to the intake manifold 36 from the return duct 44, ambient air would be drawn into the intake manifold 36.

Pipes 68, 70 extend into the middle section of the drum 20. The pipe 68 is connected at one end to a supply of liquid asphalt (not shown) and at the other end of a dispensing head 72. The other pipe 70 is connected (not shown) to the baghouse 12 so that dust removed by the baghouse may be conducted back into the drum 20 and recombined with the asphalt-aggregate material being processed in the drum in a manner known in the art.

The drum mix plant 10 operates as follows. A continuous supply of used asphalt-aggregate material 14 is delivered to the chute 23. Typically, the asphalt-aggregate material may contain up to approximately from 1 to 10% moisture. Alternately, a mixture of used asphalt-aggregate material and virgin aggregate may be introduced to the drum 20. In either case it may be necessary for additional liquid asphalt to be added to the mix through the pipe 68. Used asphalt-aggregate material, liquid asphalt and virgin aggregate are referred to herein as asphaltic raw materials. The asphalt-aggregate material slides down the chute 23 into the upper end of the rotating drum 20 for heating, mixing and drying. The flame 30 from the burner 28 provides gases of combustion at high temperatures to the pipe 32. If these high temperature gases were permitted to contact the asphalt-aggregate material, smoking of the material would result causing undesirable pollution or clogging of the filter medium in a baghouse 12.

It is found that if the asphalt-aggregate material is subjected to an initial heating temperature of approximately 500° to 1500° F., depending on the type of asphalt-aggregate material being processed in the drum mix plant 10, the smoking of the asphalt-aggregate material is eliminated or reduced. Therefore, in order to initially contact the asphalt aggregate material 14 in the upper end of the drum 20 with gases in this temperture range, it is necessary to reduce the high temperature of the combustion gases produced by the direct flame 30, which are substantially hotter than 1500° F.

It is known in conventional prior art drum mix plants that as the asphalt-aggregate material travels down the length of the rotating drum, heat exchange takes place between the asphalt-aggregate material and the heated gases which fill the drum. At the upper end of the drum the gases are at an elevated temperature and the asphalt-aggregate material is at a lower temperature. At the lower end of the drum, the temperature of the asphalt-aggregate material has been raised and the temperature of the gases has been lowered. In an ideal system with a drum of infinite length, the temperature of the gases and the asphalt-aggregate material would be the same at the lower end of the drum. However, in real life the initial temperature difference between the gases and the asphalt aggregate material is merely reduced with the gases being at a temperature higher than the asphalt-aggregate material.

It will therefore be noted that the temperature of the gases at the lower end of the drum will always be at a lower temperature than they were at the upper end of the drum. The present invention uses these cooler gases emerging from the lower end of the drum 20 to reduce the high temperature of combustion gases of the flame 30 to a temperature which will prevent smoking of the asphalt-aggregate material. This is done by recirculating the cooler gases at the lower end of the drum 20 through the return duct 44. If an apparatus not including a return duct 44 is used, ambient air is used for reducing the temperature of the combustion gases. It will be noted, however, that recirculation of gases from the drum conserves energy because such gases do not have to be heated as does ambient air.

A flow of gases through the return duct 44 is established by the recirculation fan 60. Gases from the exhaust manifold 38 and thereby conducted to the input manifold 36. These cooler recirculated gases then enter the pipe 32 from the input manifold 36 through the perforations 34 in the pipe. The temperature of the combustion gases of the flame 30 is thereby reduced by dilution with the cooler recirculated gases.

The temperature of the mixture of combustion and recirculated gases (or ambient air) leaving the pipe 32 and entering the drum 20 is automatically controlled by varying the intensity of the flame 30 to maintain a selected temperature within the 500°–1500° F. range. This is accomplished by sensing the temperature of the emerging gases with the temperature sensor 37 and through control circuitry (not shown) known in the art regulating the flame in response thereto. The temperature of gases contacting the cool asphalt-aggregate material is thus maintained at a predetermined value to avoid smoking despite variation in the temperature of the recirculated gases.

As the asphalt aggregate material travels down the rotating drum 20, heat exchange takes place between the heated gases and the asphalt-aggregate material. In order to produce a finished product by the time the asphalt-aggregate material emerges from the opening 40, the material must have achieved at least a minimum amount of heat exchange to elevate the material temperature to a desired level. The minimum temperature required to produce an acceptable product is approximately 225° to 300° F. Since the temperature of the material emerging from the opening 40 is partly dependent on the number of calories in the heated gases available for heat exchange with the asphalt-aggregate material, the temperature of the emerging material may be regulated by varying the volume of heated gases flowing through the drum 20 per unit time (this assumes a constant temperature gradient of the gases in the drum and a constant rate of travel of the asphalt-aggregate material down the length of the drum).

This product temperature regulation is accomplished in the present invention by regulating the rate of flow of gases through the drum 20, and thus regulating the volume of heating gases contacting the asphalt-aggregate material during the period such material is present in the drum. The temperature sensor 66 senses the temperature of the material emerging from the opening 40 and operates the recirculating damper 64 through electrical circuits (not shown) known in the art in response thereto. The exhaust damper 58 is similarly operated if the apparatus does not include a return duct 44 and recirculation damper 64. If the temperature of the emerging material is too low the recirculating damper 64 will open to permit more gases to flow through the return duct 44 and the drum 20. This greater flow of gases being mixed with the gases of combustion of the flame 30 would initially reduce the temperature of the gases sensed at the temperature sensor 37. However, the temperature sensor 37 would respond to the lower temperature by increasing the size of the flame 30 and thereby automatically restore the desired temperature gradient of the gases in the drum 20. The net result is that a larger volume of gases flow through the drum 20 per unit time and thereby provide a greater number of calories available for heat exchange with the cooler asphalt-aggregate material which ultimately results in a higher temperature of the material which emerges from the opening 40. Thus, it will be appreciated that the present invention automatically regulates the temperature of the emerging product while also automatically regulating the initial temperature to which the asphalt-aggregate material is subjected in order to prevent or minimize smoking of the material.

As the asphalt-aggregate material is tumbled down the rotating drum 20 a quantity of dust or suspended particulate matter is produced. Steam and combustion products may also be produced. These suspended materials, if released to the atmosphere would cause undesirable pollution.

It is known in the art that these suspended materials may be removed from the gases exiting a drum mix plant by simple filtration through a fiber filter medium. The present invention uses a conventional fiber filtration system to remove suspended particulate before the gases are released to the atmosphere.

The exhaust duct 42 conducts particulate laden gases from the exhaust manifold 38 to the filter chamber 46 of the baghouse 12. The exhaust fan 50 establishes a flow of gases through the exhaust duct 42 and the baghouse 12 as shown by the arrows 43. The particulate laden gases in the filter chamber 46 are drawn through the fiber filter collectors 48 thereby removing the suspended particulate matter therefrom. The filtered gases then enter the plenum chamber 54 and are exhausted to the atmosphere through the inlet duct 52 and the exhaust stack 56. A feature of the preferred embodiment of the present invention is that only enough particulate laden gases are removed from the system to maintain a slight negative pressure within the system. The pressure sensor 59 located within the input manifold 36 senses the ambient pressure within the input manifold and operates the exhaust damper 58 through electric circuits (not shown) known in the art in response thereto. If the pressure in the input manifold 36 is too high, the exhaust damper 58 will open, thereby releasing more gases within the system to the atmosphere. As the pressure within the input manifold 36 is reduced, the exhaust damper 58 closes, thereby retaining more of the gases within the system. A slight negative pressure is maintained for two reasons. If a positive pressure existed in the drum 20 or the return duct 44, unfiltered particulate laden gases would escape directly to the atmosphere through imperfect seals inherent in the system. This would result in undesirable pollution. The other reason is that by recirculating a large portion of the particulate laden gases through the drum 20, a significant portion of the suspended particulate matter in the recirculated gases may be agglomerated and become a part of the finished asphalt-aggregate material product. Since a significant portion of the suspended particulate matter is removed from the system as finished product, a smaller amount of the suspended particulate matter must be removed by filtration. This means that the present invention requires a smaller baghouse than drum mix plants of the prior art when the apparatus includes a return duct 44 for recirculation of gases. Also, a portion of the material removed as waste in some prior art and drum mix plants becomes finished product in the present invention, thereby improving the percentage yield of finished product.

Another feature of the present invention is that the production rate of the drum mix plant may be regulated within certain parameters. The rate at which finished asphalt-aggregate product emerges from the opening 40 is dependent upon how fast the material may be passed through the rotating drum 20. For a fixed rate of rotation of the drum 20, given the particular design of flights within the drum, the rate at which material will feed down the length of the drum is dependent upon the angle of inclination of the drum. A greater angle of inclination results in material feeding down the rotating drum 20 faster; a lesser angle of inclination results in a slower rate. The present invention provides for adjustment of the angle of inclination of the drum 20 by pivotally mounting the support frame 22 for the drum at one end on a pair of support legs 24 of fixed length and by mounting the other end of the support frame on a pair of hydraulically extendable support legs 26.

As the angle of inclination of the rotating drum 20 is increased, the rate at which asphalt-aggregate material flows through the drum increases. For a constant rate of flow of gases through the drum 20, this would result in a lower temperature for the material exiting the drum through the opening 40. The lower temperature at the temperature sensor 66 would cause the recirculation damper 64 to open wider resulting in a greater volume of gases flowing through the drum 20. The greater flow of gases would result in a lower temperature at the temperature sensor 37 which would cause the burner 28 to provide a bigger flame 37, thereby restoring the desired temperature gradient for the gases through the drum 20. Thus, it will be appreciated that the present invention permits the production rate of the drum mix plant 10 to be varied with the proper adjustments to the temperature parameters and flow of gases through the drum 20 being made automatically.

In a situation where the recirculation damper 64 is fully open and the burner 28 is providing its maximum flame 30, if the asphalt-aggregate product exiting the drum 20 through the opening 40 is below the desired level two options are available. If the gases at the lower end of the drum 20 are at a higher temperature than the temperature of the asphalt-aggregate product leaving the drum 20 through the opening 40, the inclination of the drum may be reduced to allow the asphalt-aggregate material a longer time for heat exchange while traveling down the length of the drum. If the temperature of the gases at the lower end of the drum is not great enough to raise the temperature of the asphalt-aggregate product to the desired level, the drum 20 is exceeding its maximum production rate and the rate of delivery of the asphalt-aggregate material to the chute 23 must be reduced.

The foregoing describes a drum mix plant using what is referred to as a "parallel flow" heat exchange. That is, the direction of the flow of gases through the drum 20 is the same as the direction of the flow of asphalt-aggregate material down the length of the drum. The present invention may also be used in a "counter-flow" heat exchange system, in which the direction of the flow of the gases in a drum is opposite to that of the material flowing down the length of the drum.

Figure 3:
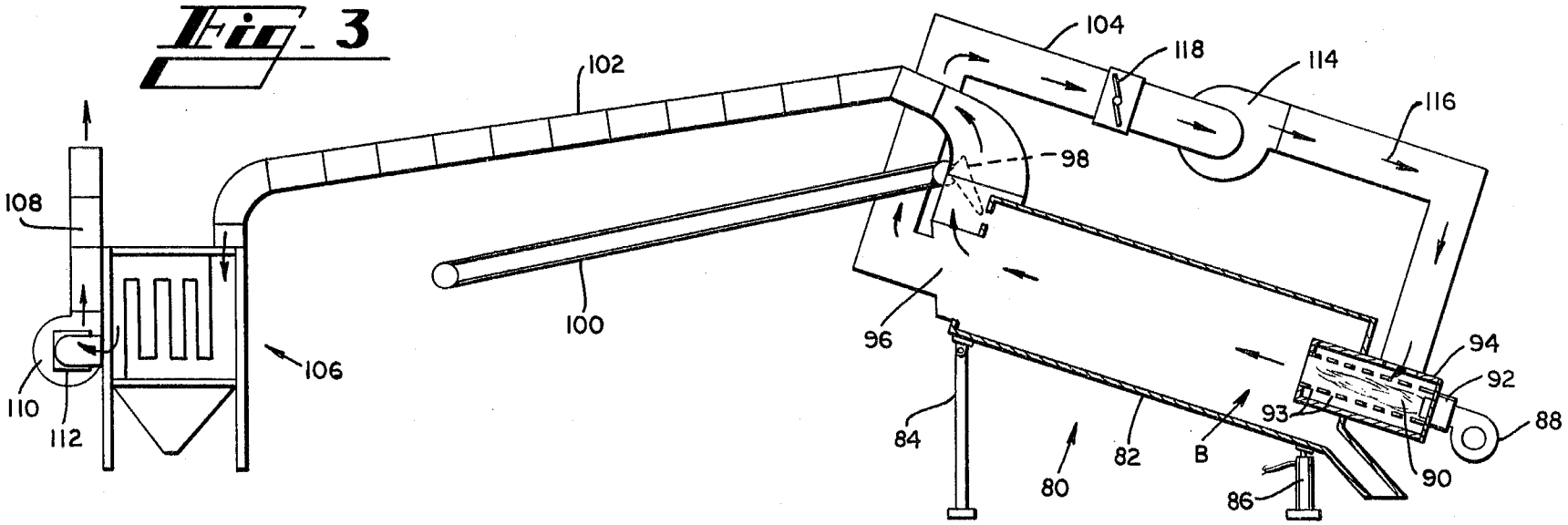
FIG. 3 is a schematic diagram of the air flow through an alternate disclosed embodiment of the present invention utilizing counter-flow heat exchange.

Referring now to FIG. 3, it will be seen that there is a counter-flow aggregate dryer 80 modified according to the invention for use as an asphalt plant to recycle used asphalt-aggregate material. Although FIG. 3 illustrates a counter-flow aggregate dryer for recycling used asphalt-aggregate material without the addition of virgin materials, it is specifically contemplated that the present invention be used in a counter-flow drum mix plant as well.

The aggregate dryer 80 includes essentially the same elements as the drum mix plant 10 shown in FIGS. 1 and 2. There is an inclined rotating drum 82 with one end pivotally mounted on a pair of fixed length support legs 84 and the other end mounted on a pair of hydraulically extendable support legs 86. By mounting the drum 82 in this manner, the angle of inclination may be adjusted. Located at the lower end of the drum 82 is an adjustable burner 88 which projects a flame 90 into a pipe 92 which extends from outside the drum into the lower end of the drum. The pipe 92 has a number of perforations 93 therein to permit gases to pass freely therethrough. Surrounding the perforated portion of the pipe 92 is an input manifold 94 which projects into and out of the drum 82.

Located at the upper end of the drum 82 is an exhaust manifold 96. Extending through the exhaust manifold 96 and into the drum 82 is a chute 98 which is adjacent the upper end of a conventional conveyor 100. The chute permits materials on the conveyor to be introduced into the interior of the drum 82.

The exhaust manifold 96 is attached to two ducts 102, 104 which are adapted for conducting gases and suspended particulate matter therein. The exhaust duct 102 leads from the exhaust manifold 96 to a conventional baghouse 106 where suspended particulate matter is removed from the gases and the filtered gases are exhausted to the atmosphere through the exhaust stack 108, in the manner described above for the baghouse 12. Air flow through the baghouse 106 is provided by an exhaust fan 110. An electrically operated exhaust damper 112 adjacent the exhaust fan 110 restricts the amount of gases flowing through the baghouse and subsequently released to the atmosphere.

The return duct 104 leads from the exhaust manifold 96 to the input manifold 94. A recirculation fan 114 attached to the return duct 104 provides a flow of gases through the return duct in a direction shown by the arrows 116. Adjacent the recirculation fan 114 is an electrically operated recirculation damper 118 which regulates the volume of gases flowing through the return duct 104.

The aggregate dryer 80 operates as follows. A continuous supply of aggregate material is delivered to the chute 98 from the conveyor 100. The aggregate material slides down the chute 98 into the upper end of the rotating drum 82 for heating and drying. The burner 88 projects a flame 90 into the perforated pipe 92. As described previously, cooler gases from the end of the drum 82 opposite the end containing the burner 88 are recirculated through the return duct 104 to the input manifold 94. The cooler gases in the intake manifold 94 enter the pipe 92 through the perforations 93 therein and are mixed with the very hot combustion gases of the flame 90, thereby providing a lower temperature at the point where the gases emerge from the pipe 92 and enter the interior of the drum 82.

In the parallel heat exchange system previously described, it is possible to initially contact the material entering the drum with gases in the range of approximately 500°–1,500° F. This is possible because the material entering the drum is not initially at an elevated temperature, and therefore requires more heat to reach the flash point of the asphalt-coated material. In a counter-flow heat exchange system, the asphalt-aggregate material initially enters the drum at the end opposite the burner. Therefore, by the time the material reaches the lower end of the drum, the material has achieved an elevated temperature and requires less additional heat to reach the flash point of the asphalt-coated material. The temperature of the gases at point B (FIG. 3) must be lower than the temperature of the gases at point A (FIG. 2) in order to prevent smoking of the asphalt-coated material in the drum. It will be appreciated from this fact, however, that the counter-flow heat exchange system is more fuel efficient than the parallel heat exchange system because the gases entering the drum at point B (FIG. 3) do not have to be elevated to a temperatue as high as the gases at point A (FIG. 2). Temperatures at point B in the counter-flow heat exchange system which prevent or minimize smoking are approximately 350° to 1,000° F. depending on the type of material being processed. Therefore, the recirculated gases do not require as much heat to be elevated to the operating temperature of the drum 82 and therefore the flame 90 does not have to be as large. Subtantial savings in fuel expenses may therefore be realized in the counter-flow heat exchange system.

It will also be appreciated that the same advantages inherent in the parallel flow heat exchange system, such as requiring a smaller baghouse than prior systems and those advantages arising from recirculation of the suspended particulate matter, also apply to the counter-flow heat exchange system. Furthermore, the same control systems described for the parallel flow heat exchange system, i.e., regulating the flame in response to product temperature, regulating the flow of recirculated gases in response to the temperature of the gases entering the drum and regulating gases exhausted to the atmosphere in response to pressure in the input manifold, are equally applicable to the counter-flow heat exchange system.

The following example is merely illustrative of the present invention.

EXAMPLE 1

A drum mix plant is provided as shown in FIG. 1. The rotating drum is 10 feet in diameter and 50 feet long. A flow of gases through the drum is established at 80,000 cubic feet per minute. The temperature of the gases at the point where they first contact the asphalt-aggregate material in the drum is 600° F. At this temperature little or no smoking of the asphalt material will occur. The temperature of the gases as they exit the rotating drum is 350° F. The difference in temperature of the gases which enter the drum from the temperature of the same gases as they leave the drum is thus 250° F.

Since the temperature of the gases which exit the drum is 350° F. and since these gases are recirculated and reintroduced to the drum, their temperature must be raised only 250° F. to achieve the operating temperature of 600° F. In contrast, assuming an ambient temperature of 70° F., in a conventional system all the gases would have to be heated 530° F. to achieve the operating temperature of 600° F.

The amount of heat required to produce these different temperature rises may be calculated from the equation:

$$Q = m\ C_p \Delta T$$

wherein Q is the amount of heat required, m is the volume of the gases, Cp is the heat capacity of the gases at constant pressure and T is the change in temperature in degrees. Assuming a heat capacity at constant pressure for the gases in the rotating drum of 0.01176 BTU/°F.-ft$^3$ the heat required in the recirculation system is:

$$Q = m\ C_p \Delta T$$

$$Q = 80{,}000\ \text{ft}^3/\text{min} \times 60\ \text{min/hr} \times 0.01176\ \text{BTU/°F.-ft}^3 \times 250\ \text{F°} \doteq 14{,}100{,}000\ \text{BTU/hr}$$

The heat required in a conventional system is:

$$Q = m\ C_p \Delta T$$

$$Q = 80{,}000\ \text{ft}^3/\text{min} \times 60\ \text{min/hr} \times 0.01176\ \text{BTU/°F.-ft}^3 \times 530\ \text{F°} \doteq 30{,}000{,}000\ \text{BTU/hr}$$

It is readily apparent that the recirculation system requires considerably less heat energy to achieve the same operating temperature as a conventional system. This results in a substantial fuel savings when using the present invention.

The theoretical production rate of the drum may be calculated as follows. Assuming a 5% heat loss through the shell of the drum, the same temperature conditions described above and a 2% moisture content for the asphalt-aggregate material, the weight of asphalt-aggregate product processed in one hour is given by the equation:

$$M_a = \frac{0.95\ Q}{C_{pa}(T_o - T_i) + M_{H_2O}\ H_{H_2O}}$$

wherein, $M_a$ is the weight in tons per hour of asphalt-aggregate material, Q is the heat per hour, as calculated above for the recirculation system, $C_{pa}$ is the spedific heat of the asphalt-aggregate material, $T_o$ is the exit temperature of the product, $T_i$ is the entry temperature of the asphalt-aggregate material, $M_{H2O}$ is the percentage of water per ton of asphalt-aggregate material and $H_{H2O}$ is the heat required to raise water temperature and evaporate it per pound of water. Substituting the appropriate values in the equation, it becomes:

$$M_a = \frac{0.95(14{,}100{,}000)\ \text{BTU/hr}}{\left[0.2\ \frac{\text{BTU}}{\text{lb° F.}}\ (300° - 70°) + 0.02(1100)\ \frac{\text{BTU}}{\text{lb}}\right]\ 2000\ \frac{\text{lb}}{\text{ton}}} \doteq 100\ \text{ton/hr}$$

It will be appreciated that for greater and smaller percentages of water and higher and lower temperature parameters, higher and lower production rates will be realized.

The embodiment of the invention disclosed herein includes the features of burner control according to the entering gas temperature, mix temperature control by varying the gas flow rate through the drum, and recirculation. Such features are individual improvements to an asphalt plant that also provide, in combination, advantages greater than the mere aggregation of their individual contributions. It should also be understood that the present invention may be used without the recirculation feature. By regulating the flame intensity in response to the temperature of the gases entering the drum, and controlling the temperature of the mix by adjusting the flow of hot gases through the drum, fuel savings may still be realized while producing a satisfactory product without recirculation of the heated gases.

It should be understood, of course, that the foregoing relates only to preferred embodiments of the present invention and that numerous modifications or alterations may be made therein without departing from the spirit and scope of the invention as set forth in the appended claims.

We claim:

1. In an apparatus for producing asphalt-aggregate material including means for mixing asphaltic raw materials in a mixing enclosure, means for continuously admitting asphaltic raw materials into said mixing enclosure, means for continuously withdrawing asphalt-aggregate material from said mixing enclosure, a variable heat source for providing high temperature gases, and means for admitting said high temperature gases into said mixing enclosure, the improvement comprising:

means for diluting said high temperature gases with dilution gases prior to admittance of said gases to said mixing enclosure;

means for withdrawing said high temperature and dilution gases from said mixing enclosure;

means for sensing the temperature of said asphalt-aggregate material as it is being withdrawn from said mixing enclosure; and means, responsive to variations in the temperature of said asphalt-aggregate material as said material is being withdrawn, for varying the rate of flow of said high temperature and dilution gases through said mixing enclosure to maintain said material as it is withdrawn at a first predetermined temperature while maintaining the temperature of said high temperature and dilution gases being admitted into said mixing enclosure at a second predetermined temperature.

2. The apparatus of claim 1, further comprising:

means for sensing the temperature of said high temperature and dilution gases entering said mixing enclosure; and means, responsive to variations in the temperature of said high temperature and dilution gases, for adjusting said heat source to maintain said gases entering said mixing enclosure at a second predetermined temperature.

3. The apparatus of claim 2 wherein said dilution gases include said gases withdrawn from said mixing enclosure.

4. In a method of producing asphalt-aggregate material including continuously admitting asphaltic raw materials into a mixing enclosure, mixing said raw materials in said mixing enclosure, admitting high temperature gases from an adjustable heat source into said mixing enclosure during mixing of said raw materials, and withdrawing asphalt-aggregate material from said mixing enclosure, the improvement comprising the steps of:

diluting said high temperature gases with dilution gases prior to admitting said gases into said mixing enclosure;

withdrawing said high temperature and dilution gases from said mixing enclosure;

sensing the temperature of said asphalt-aggregate material as it is being withdrawn from said mixing enclosure; and responsive to variations in the temperature of said asphalt-aggregate material being withdrawn from said mixing enclosure, varying the rate of flow of high temperature and dilution gases through said mixing enclosure to maintain said material being withdrawn from said mixing enclosure at a first predetermined temperature while maintaining the temperature of said high temperature and dilution gases being admitted into said mixing enclosure at a second predetermined temperature.

5. The method of claim 4, further comprising:

sensing the temperature of said high temperature and dilution gases entering said mixing enclosure; and responsive to variations in the temperature of said high temperature and dilution gases, adjusting said heat source to maintain said gases entering said mixing enclosure at a second predetermined temperature.

6. The method of claim 5 wherein said dilution gases include said gases withdrawn from said mixing enclosure.

7. In an apparatus for producing asphalt-aggregate material including means for mixing asphaltic raw materials in a mixing enclosure, an adjustable burner for producing combustion gases, and means for admitting said combustion gases into said mixing enclosure, the improvement comprising:

means for continuously admitting asphaltic raw materials into said mixing enclosure;

means for continuously withdrawing asphalt-aggregate material from said mixing enclosure;

means for diluting said combustion gases with dilution gases prior to admittance to said mixing enclosure;

means for withdrawing said combustion and dilution gases from said mixing enclosure at a location remote from said burner;

first sensor means for sensing the temperature of said asphalt-aggregate material as it is withdrawn from said mixing enclosure;

first control means, responsive to said temperature of said material as said material is withdrawn being other than a first predetermined temperature, for varying the flow of combustion and dilution gases, through said mixing enclosure to maintain said material as it is withdrawn at said first predetermined temperature;

second sensor means for sensing the temperature of said combustion and dilution gases as said combustion and dilution gases enter said mixing enclosure; and second control means, responsive to said temperature of said gases being other than a second predetermined value, for adjusting said burner to maintain said combustion and dilution gases entering said mixing enclosure at said second predetermined temperature.

8. In a method of producing asphalt-aggregate material including mixing said material in a mixing enclosure, producing combustion gases with an adjustable burner, and admitting said combustion gases into said mixing enclosure to heat said material; the improvement comprising the steps of:

continuously admitting asphaltic raw materials into said mixing enclosure and withdrawing asphalt-aggregate material from said enclosure;

diluting said combustion gases from said burner with dilution gases prior to admittance to said mixing enclosure;

withdrawing said combustion and dilution gases from said mixing enclosure at a location remote from said burner;

sensing the temperature of said asphalt-aggregate material as it is withdrawn from said mixing enclosure;

responsive to the temperature of said asphalt-aggregate material as it is withdrawn being other than a first predetermined temperature, varying the flow of combustion and dilution gases through said enclosure to maintain said material as it is withdrawn at said first predetermined temperature;

sensing the temperature of said combustion and dilution gases as said gases enter said mixing enclosure; and responsive to said temperature of said gases being other than a second predetermined value, adjusting said burner to maintain said combustion and dilution gases entering said mixing enclosure at said second predetermined temperature.

9. A drum mix asphalt plant for preparing asphalt-aggregate material comprising:

an inclined drum supported for rotation about a longitudinal axis thereof;

burner means at one end of said drum for producing combustion gases to heat the contents of said drum to an elevated temperature;

means for admitting asphalt-aggregate material to said drum at the higher end thereof;

means for removing gases from said drum and for mixing said gases with said combustion gases prior to contact with said asphalt-aggregate material;

means for withdrawing asphalt-aggregate material from said drum at a withdrawal location;

first temperature sensing means for sensing the temperature of said asphalt-aggregate material at said withdrawal location;

first control means, responsive to said first temperature sensing means, for increasing the flow of gases from said drum for mixing with said combustion gases when said temperature at said withdrawal location is below a first predetermined temperature, and for decreasing the flow of gases from said drum for mixing with said combustion gases when said temperature at said withdrawal location is above said first predetermined temperature;

second temperature sensing means for sensing the temperature of said mixture of combustion gases and gases from said drum prior to contact with said asphalt-aggregate material; and second control means, responsive to said second temperature sensing means, for varying the temperature of the combustion gases produced by said burner means to maintain said mixture of gases at a second predetermined temperature.

10. The apparatus of claim 9 wherein said gases are removed from said drum at the end of said drum opposite said burner means.

11. The apparatus of claim 9 further comprising: means for conveying a portion of said gases removed from said drum to the atmosphere; and means for conveying a portion of said gases for mixing with said combustion gases.

12. The apparatus of claim 11 wherein said means for conveying said gases to the atmosphere includes means for removing particulate matter from said gases.

13. The apparatus of claim 11 further comprising means for regulating said portion of said gases conveyed to the atmosphere to be just sufficient to maintain a negative pressure within said drum.

14. The apparatus of claim 9 further comprising a third control means, responsive to said temperature at said withdrawal location being lower than said first predetermined temperature when said flow of gases from said drum for mixing with said combustion gases is at its maximum rate, for decreasing the inclination of said drum.

15. A method of processing asphalt-aggregate material comprising the steps of:

admitting said asphalt-aggregate material into an inclined drum at the higher end thereof;

admitting combustion gases from a burner into said drum;

rotating said drum about a longitudinal axis to mix said asphalt-aggregate material and said combustion gases and to convey said material down the length of said drum;

removing gases from said drum;

mixing said gases removed from said drum with said combustion gases prior to contact with said asphalt-aggregate material;

withdrawing asphalt-aggregate material from said drum at a withdrawal location;

sensing the temperature of said asphalt-aggregate material at said withdrawal location;

increasing the flow of gases from said drum for mixing with said combustion gases when said temperature at said withdrawal location is below a first predetermined value;

decreasing the flow of gases from said drum for mixing with said combustion gases when said temperature at said withdrawal location is above said first predetermined temperature;

sensing the temperature of said mixture of combustion gases and gases from said drum prior to contact with said raw materials; and varying the temperature of said combustion gases to maintain said mixture of gases at a second predetermined temperature.

16. The method of claim 15 wherein the step of removing gases from said drum includes:

conveying a portion of said gases removed from said drum to the atmosphere; and conveying a portion of said gases for mixing with said combustion gases.

17. The method of claim 16 wherein said step of conveying a portion of said gases removed from said drum to the atmosphere includes removing particulate matter from said gases prior to releasing said gases to the atmosphere.

18. The method of claim 16 wherein said step of conveying a portion of said gases from said drum to the atmosphere comprises conveying a portion just sufficient to maintain a negative pressure within said drum.

19. The method of claim 15 further comprising the step of decreasing the inclination of said drum responsive to said temperature at said withdrawal location being lower than said first predetermined temperature concurrent with said flow of gases from said drum for mixing with said combustion gases being at its maximum rate.

* * * * *